US010493753B2

(12) United States Patent
Anderson et al.

(10) Patent No.: US 10,493,753 B2
(45) Date of Patent: Dec. 3, 2019

(54) MODULES TO EVALUATE INK SIGNALS

(71) Applicant: HEWLETT-PACKARD DEVELOPMENT COMPANY, L.P., Houston, TX (US)

(72) Inventors: Daryl E. Anderson, Corvallis, OR (US); Eric T. Martin, Corvallis, OR (US); Peter James Fricke, Corvallis, OR (US); James Michael Gardner, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/937,109

(22) Filed: Mar. 27, 2018

(65) Prior Publication Data

US 2018/0207931 A1 Jul. 26, 2018

Related U.S. Application Data

(63) Continuation of application No. 15/307,569, filed as application No. PCT/US2014/044829 on Jun. 30, 2014, now Pat. No. 1,005,276.

(51) Int. Cl.
*B41J 2/045* (2006.01)

(52) U.S. Cl.
CPC ..... *B41J 2/04541* (2013.01); *B41J 2/0459* (2013.01); *B41J 2/04586* (2013.01); *B41J 2/04588* (2013.01); *B41J 2/04591* (2013.01)

(58) Field of Classification Search
CPC .. B41J 2/04541; B41J 2/04591; B41J 2/0459; B41J 2/04586; B41J 2/04588
See application file for complete search history.

(56) References Cited

U.S. PATENT DOCUMENTS

| | | | | |
|---|---|---|---|---|
| 3,973,203 | A | 8/1976 | Kahn | |
| 4,695,849 | A | 9/1987 | Dei | |
| 5,422,266 | A | 6/1995 | Stephany | |
| 6,929,343 | B2 | 8/2005 | Farr et al. | |
| 7,717,544 | B2 * | 5/2010 | Stearns | B41J 2/14008 347/68 |
| 8,336,981 | B2 | 12/2012 | Chen et al. | |
| 2002/0063760 | A1 | 5/2002 | Dietl et al. | |

(Continued)

FOREIGN PATENT DOCUMENTS

| | | | |
|---|---|---|---|
| JP | 6-155761 | A | 6/1994 |
| JP | 155761 | A | 6/1994 |
| JP | 2007-37706 | A | 9/2007 |

(Continued)

OTHER PUBLICATIONS

IP.com search (Year: 2019).*

(Continued)

*Primary Examiner* — Lisa Solomon

(74) *Attorney, Agent, or Firm* — HP Inc. Patent Department

(57) ABSTRACT

An example device in accordance with an aspect of the present disclosure includes modules to generate an input signal, apply the input signal to an ink sample to obtain an ink signal, compare the ink signal to a reference value, and identify whether the ink signal is consistent with an ink signature. A module may be contained on an inkjet printhead die.

20 Claims, 8 Drawing Sheets

(56) References Cited

U.S. PATENT DOCUMENTS

2012/0293576 A1 11/2012 Kim et al.

FOREIGN PATENT DOCUMENTS

| | | | |
|---|---|---|---|
| JP | 2007-237706 | A | 9/2007 |
| WO | WO-2013114790 | | 8/2013 |

OTHER PUBLICATIONS

Nishigaito; "Inkjet Printing Device"; Aug. 8, 2013; p. 6, Paragraph 2, p. 8, Paragraphs 4 and 6.

Xavier Bruch; "Extending Life of Thermal Inkjet Printheads for Commercial Applications"; NIP18: International Conference on Digital Printing Technologies; Sep. 2002; pp. 103-107; San Diego, CA.

* cited by examiner

MODULES TO EVALUATE INK SIGNALS

BACKGROUND

Printer ink may be analyzed to determine various characteristics of the ink. However, such analysis may involve digitization of information using circuitry, involving a separate/dedicated convertor/analyzer. Such a device may have a large physical size and associated cost. Digital information is transmitted between the external device and the ink sample. There is a risk that such information can be manipulated by third parties.

BRIEF DESCRIPTION OF THE DRAWINGS/FIGURES

DETAILED DESCRIPTION

Examples provided herein enable the evaluation of ink properties by modules/circuitry that may reasonably be contained on an inkjet printhead die, for purposes of identifying ink health (dehydration, pigment separation, etc.). The modules/circuitry may be produced cost-effectively for use on a disposable inkjet printhead, providing for printhead self-contained ink health evaluation. Although certain examples are described with reference to ink, the same principles may apply to 3D print agents or components for digital titration or bio-printing or other high precision dispensing fluids. Accordingly, references to ink, ink sample, and so on are not meant to be limited to inkjet ink, but any dispensable material capable of affecting impedance consistent with the examples described herein. A need for communicating high frequency signals off-die (e.g., between the printhead and printer/computer) is eliminated, avoiding a need for expensive connectivity that also exposes the signals to manipulation by third parties. Examples may analyze ink properties (e.g., to discriminate between ink types) based on various characteristics of the ink signal, including amplitude characteristics and phase angle characteristics corresponding to various input signal frequencies and associated evaluation intervals.

Figure 1:
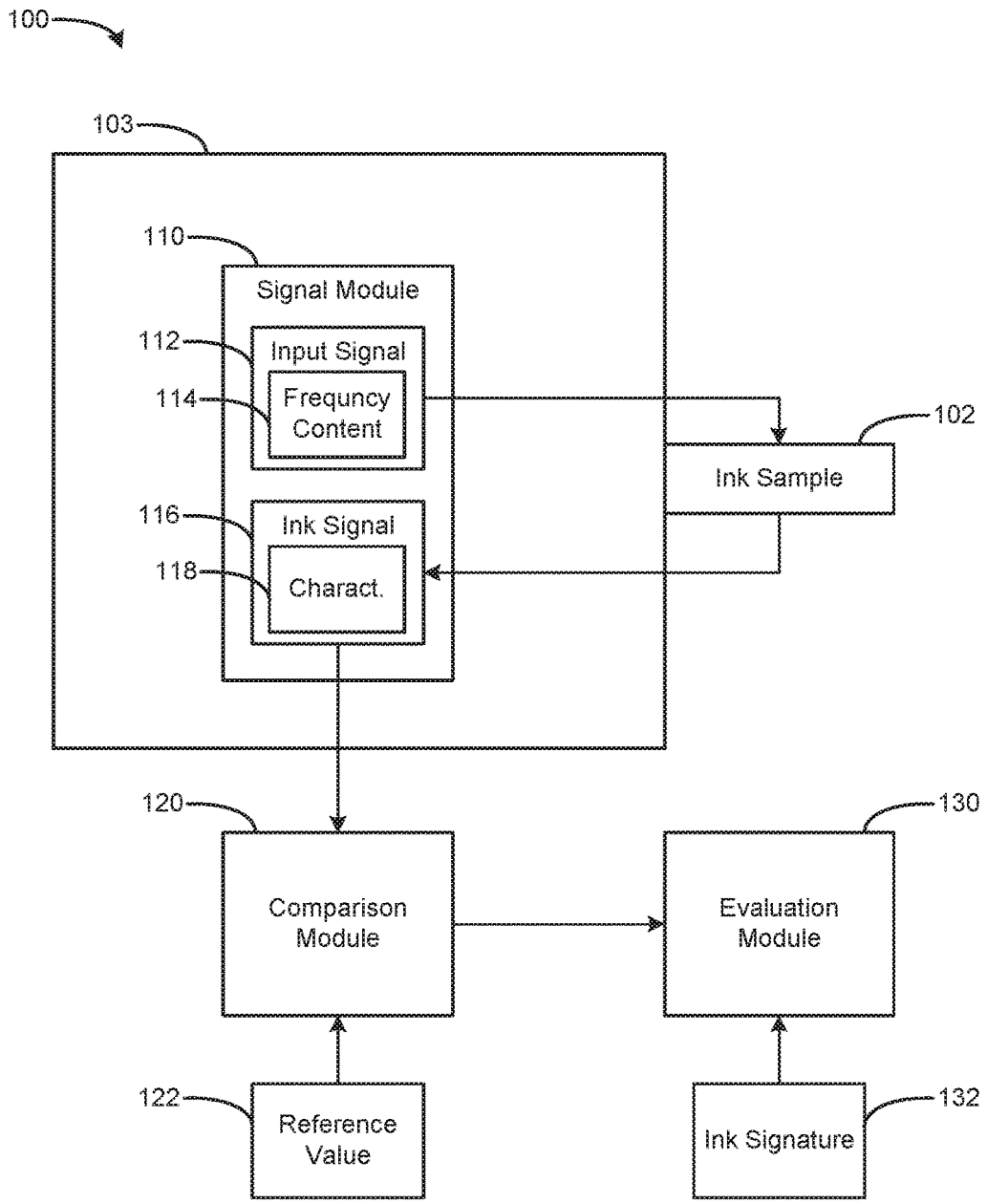
FIG. 1 is a block diagram of a device including a signal module according to an example.
Figure 2:
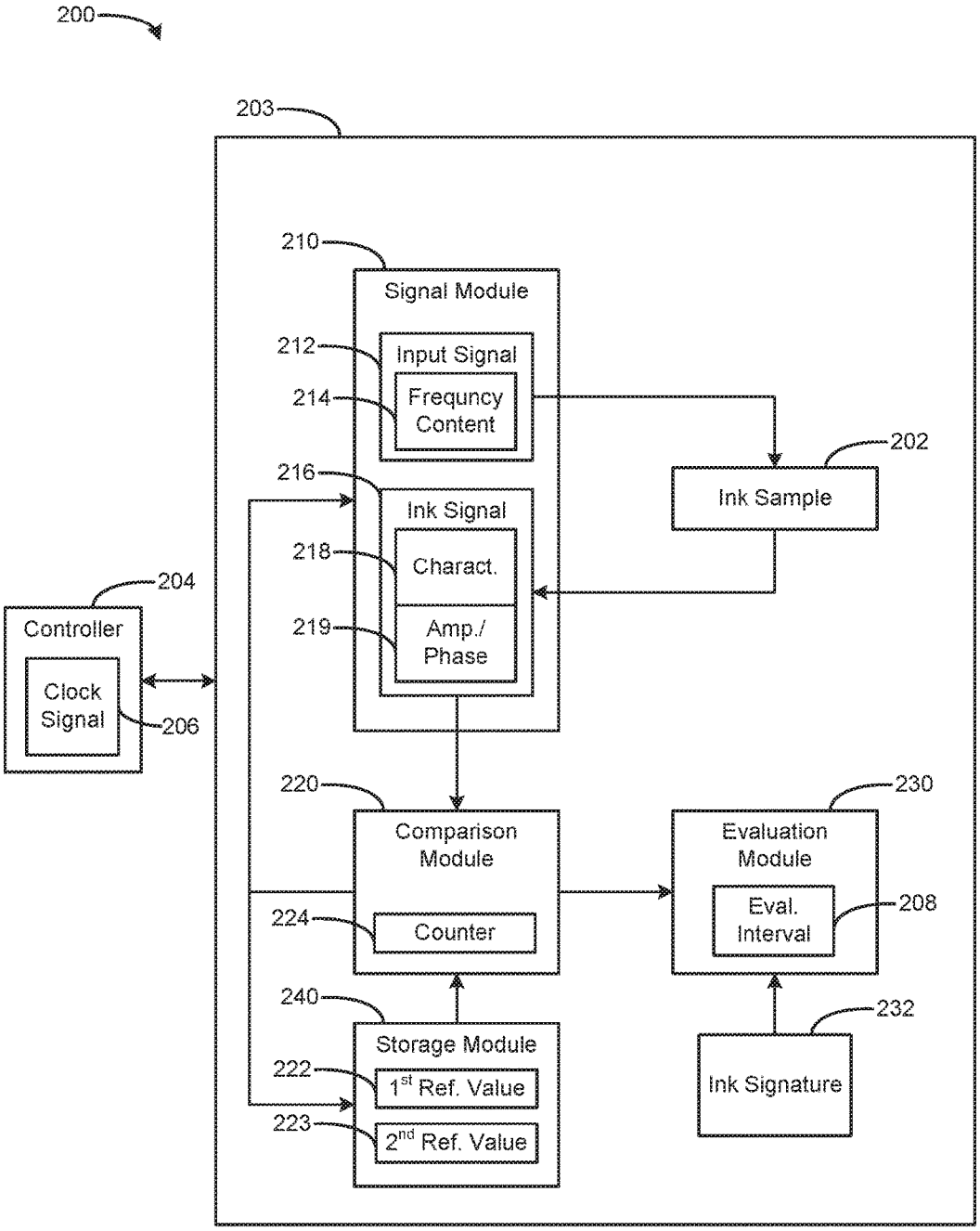
FIG. 2 is a block diagram of a device including a signal module according to an example.

FIG. 1 is a block diagram of a device 100 including a signal module 110 according to an example. The device 100 is fluidically coupled to an ink sample 102, e.g., corresponding to an inkjet nozzle/chamber/electrode. The device 100 also includes a comparison module 120 and evaluation module 130. The signal module 110 is to provide input signal 112 and receive ink signal 116. The input signal 112 is associated with frequency content 114. The ink signal 116 is associated with a characteristic 118. The ink signal 116 is communicated to the comparison module 120, which is associated with a reference value 122. Results of the comparison module 120 are evaluated by the evaluation module 130. The evaluation module 130 is to identify whether the results are consistent with an ink signature 132. FIG. 1 shows the comparison module 120 and the evaluation module 130 as being separate from the die 103. In alternate examples, a module may be on-die or off-die (e.g., see FIG. 2 showing additional modules on-die). Furthermore, modules may be combined and/or omitted, e.g., combining and/or moving functionality from one module to another module.

In operation, an input signal 112 having frequency content 114 may be applied to the ink sample 102 to be analyzed, e.g., ink that is fluidically coupled to sensor(s)/electrode(s) associated with an inkjet printhead nozzle. An ink signal 116 response may be evaluated for characteristics 118. This process may be iteratively repeated for various frequencies, by applying an input signal 112 of a given frequency content 114 for an evaluation interval to evaluate characteristics 118 of the ink signal 116, adjusting the frequency content 114, and applying the updated input signal 112. Various frequencies may be "swept" across the ink sample 102, to obtain a plurality of ink signals 116 and corresponding characteristics 118. The results may form an electrical response that may be compared and evaluated against "known healthy ink," e.g., compared to a response referred to as an ink signature 132. In alternate examples, the ink sample 102 may be analyzed to build a representative ink signature 132 for that ink sample 102.

The signal module 110 may generate the input signal 112, and corresponding frequency content 114, based on a clock signal or other available signal. For example, a clock signal may be available at an inkjet printhead die 103, and the clock signal may be digitally divided and filtered to create a sine wave and subdivisions thereof, including approximations thereof that may include a wider range of frequency content than a pure sine wave.

The resulting ink signal 116 obtained from the ink sample 102 contains characteristic(s) 118. For example, a characteristic 118 may indicate a frequency amplitude corresponding to the frequency content 114 of the input signal 112 for an evaluation interval. The characteristic 118 may indicate a phase of the ink signal 116, e.g., a phase angle between a voltage and a current related to an impedance of the ink sample 102 for a given frequency content 114 of an evaluation interval. Responses by the ink sample 102 to input signals 112 of varying frequency content 114 over multiple evaluation intervals will correspondingly vary, in accordance with a signature of the ink sample 102 that may identify the ink and distinguish it from faulty or third party ink. Such responses may be passed to the comparison module 120.

The comparison module 120 may compare the characteristic 118 to the reference value 122. The reference value may be set/initialized and stored at the device 100, e.g., by an external controller or printer (not shown in FIG. 1) that loads a storage (not shown in FIG. 1) associated with the comparison module 120. In an alternate example, the reference value 122 may be set during manufacture of the device 100, e.g., storing a value at a memory of the device 100 based on a value determined via empirical analysis of ink and nozzle health behavior/characteristics. Accordingly, the reference value 122 may be chosen to be consistent with and relevant to a type of expected characteristic 118, and the reference value 122 may include multiple different values (e.g., a first reference value for comparing against frequency/amplitude characteristics, and a second reference value for comparing against phase characteristics).

The evaluation module 130 may evaluate, over time for a given number of multiple iterations, how the characteristic(s) 118 of the ink signal 116 have compared with the reference value(s) 122. The evaluation module 130 also may evaluate a comparison of a number of multiple reference values 122 to corresponding characteristic(s) 118. Thus, the evaluation module 130 may consider multiple pieces of data for a given iteration/evaluation intervals, and may consider multiple pieces of data over a plurality of iterations/evaluation intervals. The signal module 110 may provide the multiple pieces of data based on applying a plurality of input signals 112 having a corresponding plurality of different frequency content 114. The ink sample 102 will have different responses at different frequencies, enabling the evaluation module 130 to identify a "fingerprint" of the ink (which may be used to build an ink signature for the ink sample 102). The ink sample 102 behavior may be matched against a type of expected behavior, such as a sample ink signature 132. Thus, the evaluation module 130 may build an ink signature 132 consistent with the ink sample 102, and the evaluation module 130 also may test the ink sample 102 to see if it is consistent with en existing (e.g., predetermined) sample ink signature 132.

The ink signature 132 may be predetermined empirically for an expected type of ink sample 102, such as an official/original ink supply of an inkjet cartridge to be paired with a printhead die. Such an ink signature 132 may correspond to a unique stock keeping unit (SKU) of an ink manufacturer, such that the device 100 may verify whether the ink sample 102 is consistent with at least some discrete points of the predetermined ink signature 132. In an example, a device may determine whether an ink sample is consistent with a plurality of different acceptable SKUs of inks.

The evaluation module 130 may evaluate the ink sample 102 according to the evaluation interval. The evaluation interval also may be identified empirically, for expected types of ink samples 102. The evaluation interval may typically be on the order of microseconds, to provide a timeframe of sufficient time to allow the ink signal 116 to stabilize in value. The evaluation interval also will allow enough processing cycles for the device 100 to evaluate whether or not the ink signal 116 is comfortably within range (e.g., consistent with the ink signature 132). The evaluation interval may be adjusted as needed.

The device 100 may operate iteratively (e.g., sweep through a range of values) according to various approaches, to evaluate the ink signal 116 and associated characteristic(s) 118. For example, the signal module 110 may generate an initial input signal 112, and comparison module 120 may compare it with an initial reference value 122. The signal module 110 may iteratively adjust the input signal 112, and/or the comparison module 120 may iteratively adjust the reference value 122, until the ink signal 116 is consistent with the reference value 122, at which point the evaluation module 130 may evaluate the results of the plurality of iterative comparisons.

In an example iterative approach, the device 100 cycles through various values of the frequency content 114 of the input signal 112, resulting in the ink signal 116 containing different voltage amplitude and phase characteristics 118. Also, the reference value(s) 122 may be changed/updated (swept) to try to match the expected different characteristics 118. The device 100 may thereby pinpoint a given reference value 122 that best corresponds to a given value for the frequency content 114 for that ink sample 102. The device 100 thereby may effectively characterize, for a given ink sample 102, a fairly accurate ink signature 132 consistent with the ink sample 102.

In another example iterative approach, the reference value(s) 122 may be allowed to remain constant, and the signal module 110 may vary the input signal 112 (e.g., by changing a value of a variable resistor in series with the ink sample 102), while also varying the value of the frequency content 114. The comparison module 120 is to compare whether the resulting characteristic 118 of the ink signal 116 remains comparable to the reference value 122 across the varying frequencies applied to the ink sample 102. Thus, instead of varying the reference value(s) 122, the input signal 112 is varied to obtain a match with the reference value 122.

Such approaches may be used to determine different types of characteristics 118. For example, to evaluate an ink sample 102 based on phase characteristics, the reference value 122 may be held constant while the input signal 112 (e.g., frequency content 114) is varied across iterated evaluation intervals. Multiple comparisons may be performed for different frequencies/evaluation intervals of the input signal 112, to evaluate the phase characteristic 118. The input signal 112 may be applied to the ink sample 102 as a voltage level at various frequencies, and the ink sample 102 may respond with an ink signal voltage and an ink signal current. The comparison module 120 may consider the amplitude of the voltage ink signal response, and the phase between the voltage ink signal response and the current ink signal response, to identify the phase characteristic.

By performing these operations on an inkjet printhead die, the printhead itself may evaluate the ink sample 102, without communicating off-die (e.g., with the printer/computer), where signals could be intercepted or otherwise compromised. In alternate examples, such information (and modules) may be provided off-die. In an alternate example, the printhead may write an identifier (e.g., a warranty bit) to 'red flag' the device 100, without a need to send or receive signals off-die. Accordingly, a 3rd party is not given easy access to corrupt or alter the signal/data in an attempt to prevent or overwrite the identifier. In an example, a visible indicator (e.g., a fuse) may be used to provide a visible indication of an issue with the ink sample 102. Accordingly, warranty returns of an inkjet printhead die may self-identify whether an ink sample 102 has failed to be consistent with a desired ink signature 132. In an alternate example, the printhead die may contain a programmable storage/bit, e.g., in on-die memory, which a printer may routinely access to verify the bit and enable standard printer operation, whereby the printer may treat the printhead differently according to the programmable storage being set to a problem state. Thus, a printhead may effectively void its own warranty without providing an opportunity for a $3^{rd}$ party to reverse-engineer or otherwise prevent such action.

FIG. 2 is a block diagram of a device 200 including a signal module 210 according to an example. The device 200 is fluidically coupled to ink sample 202, e.g., corresponding to an inkjet nozzle/chamber. The device 200 also includes a comparison module 220, an evaluation module 230, and a storage module 240. The signal module 210 is to provide input signal 212 and receive ink signal 216. The input signal 212 is associated with frequency content 214. The ink signal 216 is associated with a characteristic 218, which may include amplitude and/or phase characteristics 219. The signal module 210 also may receive control signals from comparison module 220 and/or controller 204 (e.g., for iterative/feedback operation). The controller 204 may provide clock signal 206, e.g., for identifying an evaluation interval 208. The ink signal 216 is communicated to the comparison module 220. The comparison module 220 includes counter 224, and is coupled to the storage module 240 to receive at least one of i) the first reference value 222 and/or ii) the second reference value 223. Results of the comparison module 220 are passed to the evaluation module 230. The evaluation module 230 is to evaluate the results in view of at least one evaluation interval 208 and an ink signature 232. FIG. 2 shows the comparison module 220 and the evaluation module 230 as being on-die with other modules. In alternate examples, a module may be on-die or off-die.

The clock signal 206 is available to be used by the signal module 210 to generate sine waves of a variety of frequencies. The signal module 210 may modify the clock signal 206, e.g., a clock signal that is provided to a printhead by printer electronics and/or a computer. The clock signal 206, generally a square wave, may be filtered by the signal module 210 to approximate a sine wave. The filtering may be based on a simple resistor-capacitor (RC) low-pass filter, for example. The clock signal 206 also may be subdivided according to various values (e.g., 2, 4, 8, etc.) to create additional frequencies. In an example, an RC filter may be for generating multiple subdivisions of frequencies, based on tuning at least one of the R and/or C components.

Such sine waves may be used (e.g., applied in sequence) to drive a signal through a series-connected divider resistor, into the ink sample 202, based on an electrode (not shown in FIG. 2) in contact with the ink sample 202. A second electrode also may be used to contact the ink sample 202 and complete an electrical circuit with the ink sample 202. A voltage amplitude characteristic 218 of the resulting ink signal 216 sine wave obtained at the ink sample electrode may be a function of a resistor divider circuit. The resistor divider circuit (see, e.g., FIG. 3) may include the divider resistor, and an impedance value of the ink sample 202 at the specific frequency content 214 that is applied.

The device 200 may be operated iteratively by shifting at least one of the reference values 222, 223, which may be used by the comparison module 220 as a threshold voltage(s) against which the ink signal 216 is compared. The reference values 222, 223 may be used to determine when the ink signal 216 meets or exceeds the threshold, according to a comparison. In an example, the first reference value 222 may be a frequency voltage amplitude characteristic, and the second reference value 223 may be a phase characteristic. The device 200 may perform multiple (e.g., iterative) such comparisons/measurements, based on multiple input signals 212 and corresponding frequency content 214 over a plurality of evaluation intervals. In an iteration, the threshold reference values 222, 223 may be set at an updated value. For example, the reference values 222, 223 may be set low, and the comparison module 220 may check whether the ink signal 216 meets or exceeds the reference values 222, 223. If not, the reference values 222, 223 may be incremented (or, in an alternate example, decremented), and another iteration may be performed. Iterations may be repeated until the comparison module 220 identifies that the ink signal 216 meets or exceeds at least one of the reference values 222, 223, at which point value(s) for the ink signal 216 have been characterized (e.g., value(s) corresponding to the reference values 222 and/or 223). The counter 224 also may be used for characterization. Thus, the ink signal 216 may be characterized based on reference value(s) 222, 223, and timing of the counter 224, which can characterize the shape/slope of the ink signal 216 over time according to iteratively comparing with threshold reference value(s) 222, 223.

Figure 3:
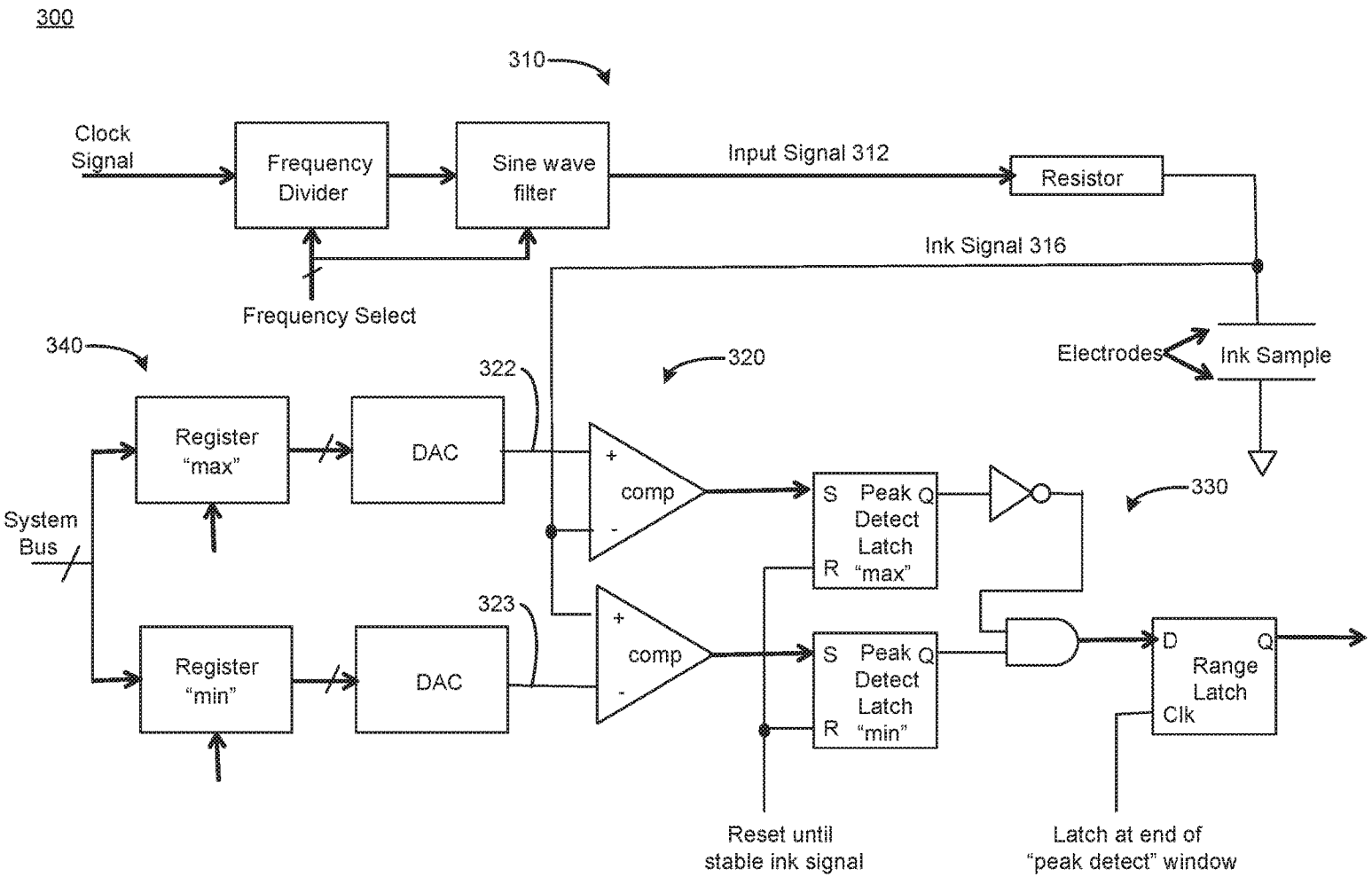
FIG. 3 is a block diagram of a device including a signal module according to an example.

FIG. 3 is a block diagram of a device 300 including a signal module 310 according to an example. The device also includes a comparison module 320, evaluation module 330, and storage module 340.

Signal module 310 is to receive the clock signal and/or a subdivision thereof. A number of different frequencies may be used, based on the frequency divider block and the sine wave filter block to generate different frequencies. The resulting input signal 312 may be fed into a resistor divider based on the illustrated known resistor as a first resistor, and the ink sample serving as an impedance having unknown resistance, in series with the known resistor (which may be a variable resistor for varying the resulting ink signal 316). Resistance of the ink sample should vary with frequency in accordance with an ink signature for that ink. Based on what impedance/resistance the ink sample assumes in response to a given frequency of the input signal 312, an intermediate voltage taken between the resistor and ink sample may serve as the ink signal 316, which is passed from the signal module 310 to the comparison module 320.

The comparison module 320 includes two voltage comparators to compare the ink signal 316 against two preset values (e.g., a first reference value 322 and a second reference value 323). In this example circuit, the lower comparator may compare whether the second reference value 323 (e.g., a minimum) is at least exceeded. The upper comparator may compare whether the first reference value 322 was not exceeded. Accordingly, the two comparators may perform a range check on the ink signal 316. In an example, values for reference values 322, 323 may be loaded and stored at registers of the storage module 340. The registers may maintain these value(s) for a duration of the evaluation interval for a specific frequency content. In an alternate example, the reference values 322, 323 may be stored in an on-die memory such as an electrically programmable read-only memory (EPROM) to avoid a need for communication of the reference values from a controller/printer to the die. The reference values 322, 323 of the registers are converted to analog voltages by digital to analog converters (DACs or D2As). The analog voltages of the reference values 322, 323 may be fed to the two comparators. In an alternate example, a DAC and a comparator may be omitted, by time-multiplexing the measurements and sharing the remaining DAC and comparator. Additionally, examples enabling the borrowing/repurposing of existing circuitry available on-die, such as by using circuit elements that are present on the printhead die for temperature control and so on.

The first reference value 322 may represent a maximum (or slightly greater than maximum) peak amplitude expected of the ink signal 316 at the given frequency associated with that evaluation interval. Similarly, the second reference value 323 may represent the minimum expected amplitude. By means of the two comparators, the comparison module 320 may determine whether the peak value of the ink signal 316 is within a range defined by the two preset reference values 322, 323. Outputs from the two comparators may feed into the evaluation module 330.

The evaluation module 330 may include latches and logic to evaluate the output of the comparison module 320. Output from the comparators may be received as a "set" input of two set/reset latches used for peak detection. The latches may initially be held in "reset" until an evaluation window (time) when the ink signal 316 has become stable for the given frequency of the evaluation interval. In an alternate example, other circuit elements may be used. For example, other types of peak-detect or threshold detector circuits may be used. The evaluation module 330 may evaluate outputs of the two latches via logic gates to determine if i) the minimum amplitude of the second reference value 323 was achieved, and if ii) the maximum amplitude of the first reference value 322 was not exceeded. That binary result may be latched by the "range" latch of the evaluation module, for communication to the printer or other controller, or even "accumulated" in on-die circuitry of a printhead for eventual determination of ink characteristics.

The device 300 may be used repeatedly/iteratively for as many frequencies/evaluation intervals as desired for satisfactory ink characterization. For example, at each frequency/evaluation interval, minimum and maximum reference values are loaded into the range registers, the two peak detect latches are held reset, an input signal 312 is applied to the ink sample, a peak value of the ink signal 316 is "range tested" by the two comparators while the peak detect latches have their reset turned off, and logic (NOR and AND gates) identifies whether the ink signal peak value was in range.

A latching circuit may be used to accumulate the results of the range testing of the ink signal for various frequencies. For example, an "ink good" latch can be initially set "true." Each successive peak value range result can be applied to the latch to reset it, based on the range signal being false (peak was out of range). A range fail at any frequency may reset ("ink bad") the latch for the duration of the evaluation. That overall evaluation result can then be communicated to the printer and/or used on-die to modify the behavior of the printhead.

Thus, the various examples/modules discussed herein may be achieved using a minimal amount of circuitry to determine ink characteristics/signatures. The circuitry is minimal enough to be contained on the limited real-estate of a printhead die. Accordingly, the examples described herein enable the printhead die to have self-contained ink evaluation. This can eliminate a need for communicating analog signals, such as an ink failure indicator, off-die, resulting in avoiding extra connectivity expenses, and avoiding a need to expose the signals off-die, where the signals may be manipulated by third parties. Further reduction in circuit elements is possible, e.g., by sharing other components available on the printhead die, such as registers, counters, gates, etc., by using additional logic gates and pass transistors to multiplex the circuit elements for use in various modules.

Figure 4:
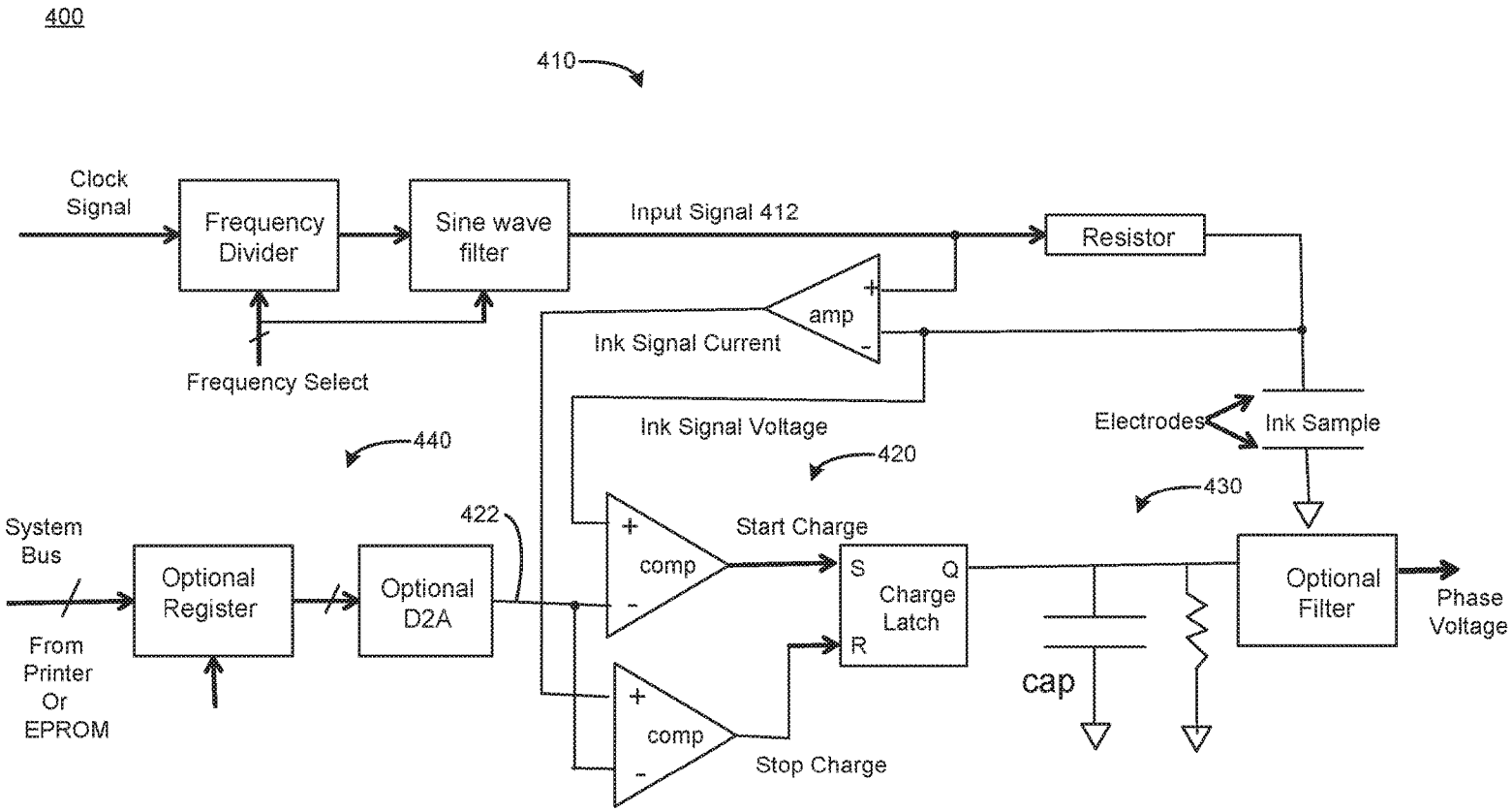
FIG. 4 is a block diagram of a device including a signal module according to an example.

FIG. 4 is a block diagram of a device 400 including a signal module 410 according to an example. The device 400 also includes a comparison module 420, evaluation module 430, and storage module 440.

The signal module 410 includes a frequency divider and filter to convert a clock signal to an input signal 412 that contains frequency content. The input signal 412 is applied to a resistor in series with the ink sample, providing a resistor divider arrangement. Input signals for an amplifier are provided by the values across the resistor, such that the output of the amplifier provides an ink signal current. The amplifier may provide a gain appropriate for the next module/stage of the circuit. The ink signal current and ink signal voltage are passed to the comparison module 420.

The comparison module 420 includes two comparators. A reference value 422 may be stored digitally in an optional register, and converted to an analog value by the optional D2A, for comparison by the two comparators. In an alternate example, the register and D2A may be omitted, and the reference value 422 may be applied directly to the comparators. The reference value 422 may be chosen low enough so that the comparators will flip when the ink signal voltage and ink signal current are rising. Because the ink signal voltage is connected to one of the comparators, and the ink signal current is connected to the other, a timing between the flipping of the two comparators is related to a phase characteristic (e.g., phase angle) of the ink signal. The phase angle may vary according to the particular reference value 422 that is chosen (e.g., increasing or decreasing the phase angle between voltage and current ink signals). Output of the comparison module 420 may be fed to an evaluation module 430.

The evaluation module 430 may include an RC circuit (illustrated by the capacitor in parallel with the resistor at the output of the charge latch). The RC circuit may be used to smooth out the phase information that is passed from the comparators through the charge latch. When the ink signal voltage comparator flips high, it begins charging the capacitor. When the ink signal current comparator flips high, the charging ends. A bleeder resistor is to constantly discharge the capacitor. Accordingly, the greater the phase angle between the ink signal current and ink signal voltage, the greater the time between the flipping of the two comparators, and the greater the resulting charge/voltage on the capacitor.

The device 400 may consider the amplitude of the ink signal voltage waveform that is coming off the ink sample, while simultaneously considering the ink signal current (by sensing the voltage drop across the resistor in series with the ink sample). The reference value 422 is used to set a 'trip' point, or reference level, for the two state comparators to turn on and off. Thus, operation of the comparators may control the charge function of the charging latch.

The voltage on the capacitor may be further filtered and then analyzed. Alternatively, the voltage on the capacitor may be sampled and held at a fixed time (such as when one of the comparators flips). In an example, the results of the evaluation module 430 may be digitized, "range compared," or used in other ways by the existing circuitry (registers, D2A, comparators), for the purpose of checking that the ink has an appropriate phase angle at the given frequency. This comparison may be repeated/iterated at as many frequencies and corresponding evaluation intervals as desired, to improve the analysis of the ink and resulting ink signature.

Thus, the minimal circuit shown in FIG. 4 may use the reference value 422 to set a point at which the ink signal voltage will start charging off the capacitor, and the ink signal current will stop the charging. The value of a filtered charge signal may be evaluated to determine whether it is consistent with an expected value of a corresponding ink signature (and/or may be used to build an ink signature consistent with the plurality of evaluation intervals/frequencies). The circuits of FIG. 4 and FIG. 5 also may be combined, by sharing the common circuit elements/modules. An example device may use both analysis approaches of FIGS. 4 and 5 together, for enhanced ink analysis by considering amplitude and phase characteristics. Redundant and/or overlapping circuits/modules may be omitted or otherwise streamlined/reduced if using both approaches (e.g., multiplexing and sharing of circuit elements).

Figure 5:
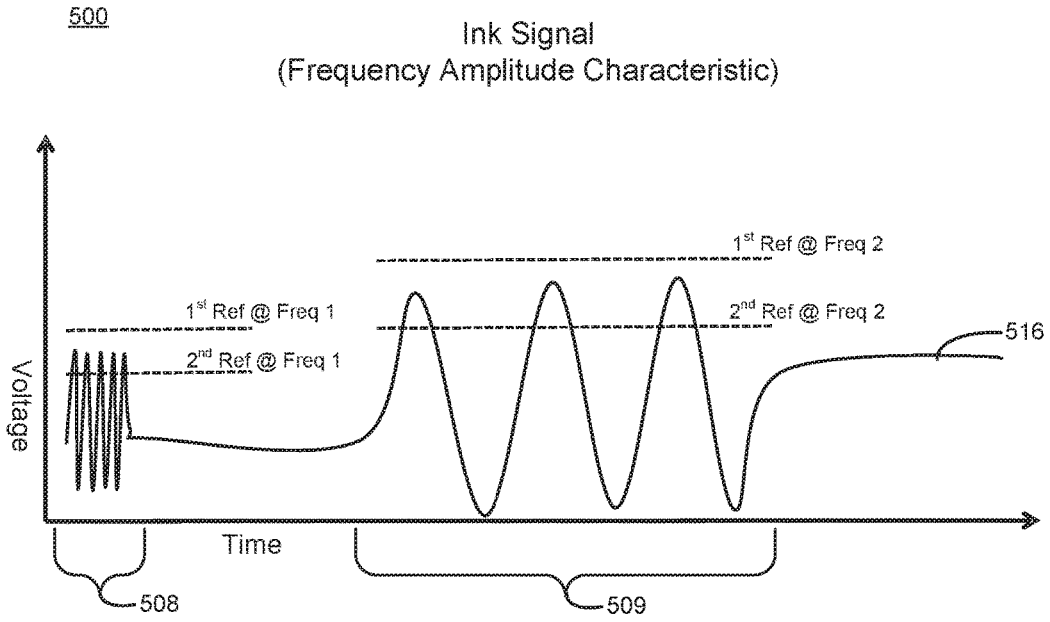
FIG. 5 is a chart showing an ink signal of a device according to an example.

FIG. 5 is a chart 500 showing an ink signal 516 of a device according to an example. Chart 500 also shows a first evaluation interval 508 and a second evaluation interval 509, corresponding to respective first and second frequency characteristics.

Two evaluation intervals 508, 509, are illustrated. For a given evaluation interval, a corresponding frequency characteristic of the ink signal is evaluated. The resulting frequency characteristic corresponds to a frequency content of the input signal applied to an ink sample. The ink signal is evaluated to determine whether, at a reference frequency, the amplitude is within a maximum/minimum range as set by, e.g., a first reference value and a second reference value. Accordingly, each evaluation interval 508, 509, is associated with its own set of first/second reference values. As illustrated, the first evaluation interval 508 has an amplitude that remains within the bounds of the first and second reference values for that first frequency characteristic. Similarly, the second evaluation interval 508 has an amplitude that remains within the bounds of the first and second reference values for that second frequency characteristic. Two frequency characteristics/iterations are illustrated, showing that the ink signal of FIG. 5 is consistent with an ink signature based on falling within the upper and lower bounds of the plurality of evaluation intervals. In alternate examples, any number of frequency characteristics/iterations may be used (e.g., to obtain additional information consistent with an ink signature).

Figure 6:
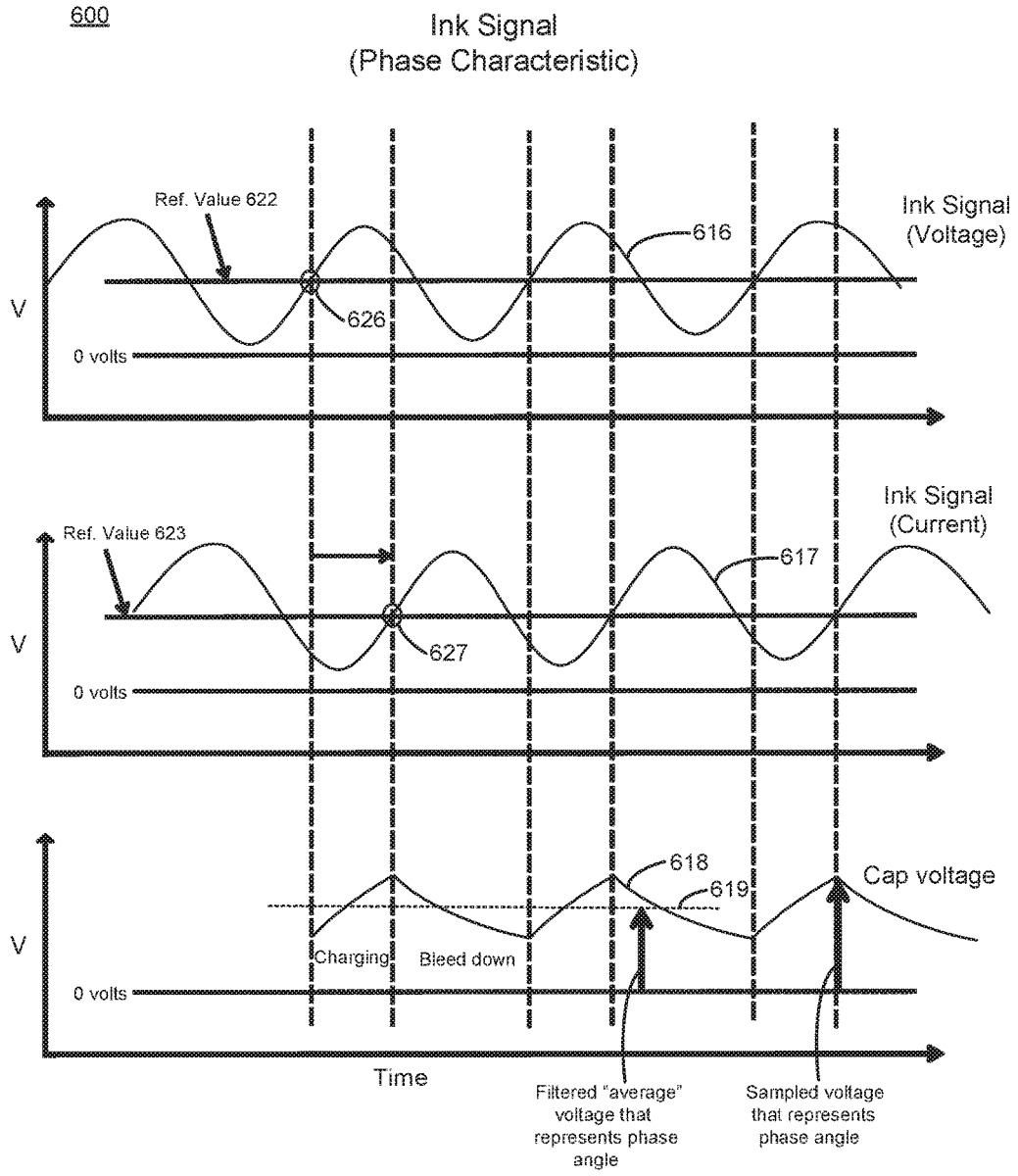
FIG. 6 is a chart showing an ink signal of a device according to an example.

FIG. 6 is a chart 600 showing an ink signal 616 of a device according to an example. The ink signal 616 is an ink signal voltage 616, and chart 600 also shows an ink signal current 617. Additionally, chart 600 shows a sampled voltage 618 of a phase characteristic, as well as an averaged voltage 619 of the phase characteristic.

The sampled voltage 618 of the phase characteristic illustrates charging of a capacitor, for the time when the ink signal voltage 616 crosses the reference value 622 at the first intersection 626, and when the ink signal current 617 'catches up' and crosses the reference value 623 at the second intersection 627. The difference in the (represented by the horizontal arrow between the times of the intersections) indicates the phase characteristic. The greater the difference in phase, the longer time the capacitor has to charge up.

The reference values 622, 623 are equal to each other in chart 600, and have been chosen to place the first and second intersections 626, 627 at a portion of the sinusoidal signals that enables improved evaluation of the transitioning waveforms 616, 617. In other words, the first and second intersections 626, 627 are set by choosing the reference values 622, 623 to avoid troughs or peaks of the sinusoid signals (where the intersection points might be relatively stalled time-wise). Placing the intersections 626, 627 approximately halfway up their respective waveform slopes enhances evaluation precision and enables clearer, easier-to-resolve signals (phase).

The reference values 622, 623 may be chosen to differ from each other, e.g., by moving reference value until the signals cross each other. However, a single value may be chosen for both reference values 622, 623, to establish enhanced time discrimination at the occurrence of the transition along a portion of the waveform away from a peak and/or trough.

Figure 7:
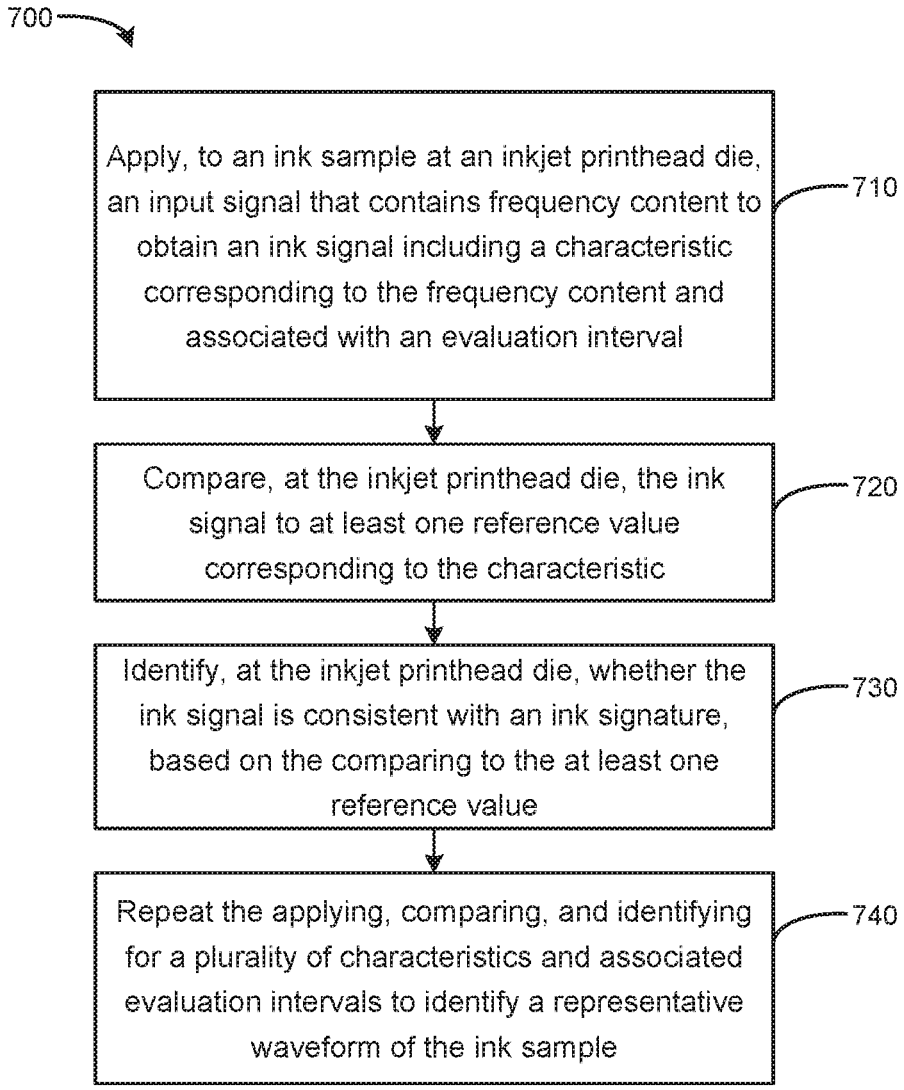
FIG. 7 is a flow chart based on identifying a representative waveform of an ink sample according to an example.
Figure 8:
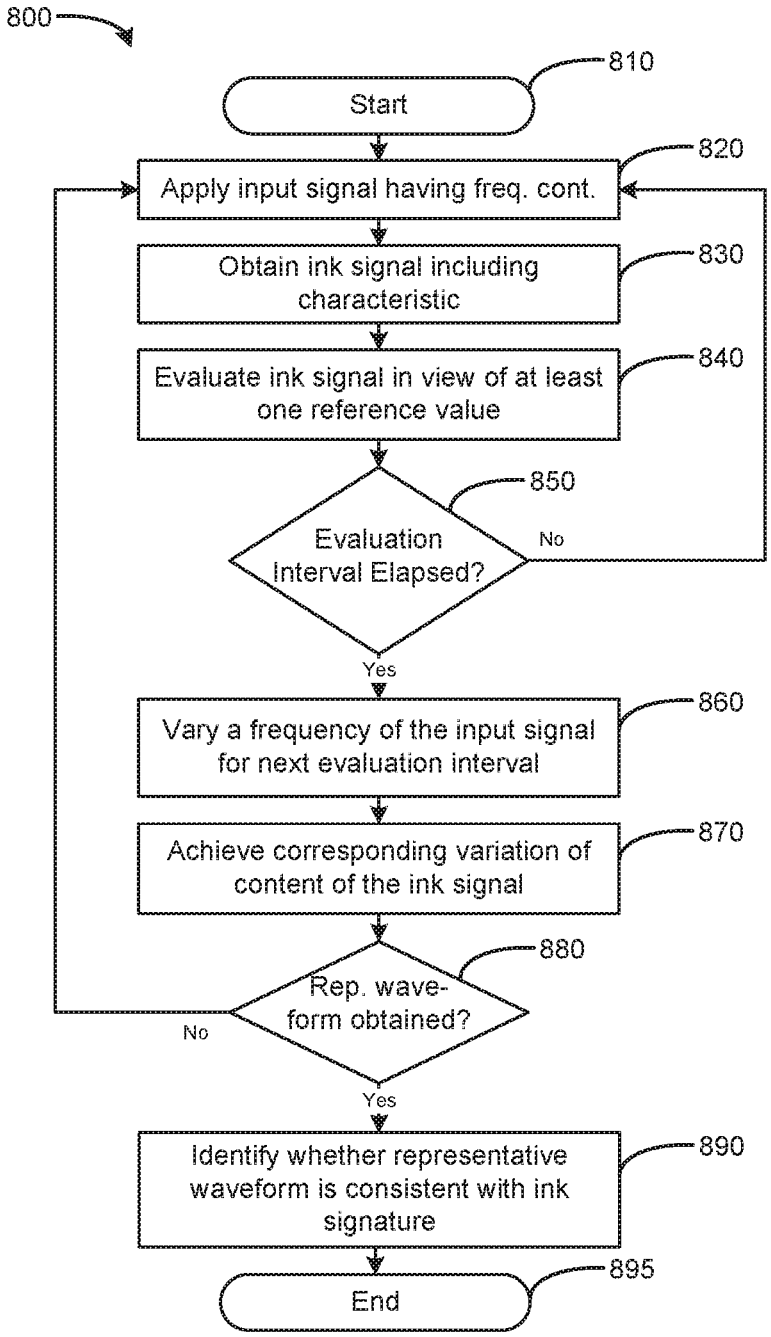
FIG. 8 is a flow chart based on identifying whether a representative waveform is consistent with an ink signature according to an example.

Referring to FIGS. 7 and 8, flow diagrams are illustrated in accordance with various examples of the present disclosure. The flow diagrams represent processes that may be utilized in conjunction with various systems and devices as discussed with reference to the preceding figures. While illustrated in a particular order, the disclosure is not intended to be so limited. Rather, it is expressly contemplated that various processes may occur in different orders and/or simultaneously with other processes than those illustrated.

FIG. 7 is a flow chart 700 based on identifying a representative waveform of an ink sample according to an example. In block 710, an input signal is applied, to an ink sample at an inkjet printhead die, that contains frequency content to obtain an ink signal including a characteristic corresponding to the frequency content and associated with an evaluation interval. For example, a device may apply, during an evaluation interval, an input signal associated with a frequency content that causes an ink sample to return an ink signal of a given voltage amplitude and phase corresponding to that frequency content, consistent with the ink's signature. In block 720, the ink signal is compared, at the inkjet printhead die, to at least one reference value corresponding to the characteristic. For example, the ink signal may be compared to values representative of amplitude and/or phase. In block 730, it is identified, at the inkjet printhead die, whether the ink signal is consistent with an ink signature, based on the comparing to the at least one reference value. For example, if the ink signal remains within acceptable range of the reference values for a given evaluation interval, the corresponding ink signal frequency content for that evaluation interval may be deemed consistent with an ink signature. In block 740, the applying, comparing, and identifying are repeated for a plurality of characteristics and associated evaluation intervals to identify a representative waveform of the ink sample. For example, a series of evaluation intervals may be used to generate sufficient data to confirm whether an ink sample is an original, OEM authorized ink or a third party ink, based on matching the ink signature to a representative waveform.

FIG. 8 is a flow chart based on identifying whether a representative waveform is consistent with an ink signature according to an example. Flow starts at block 810. In block 820, an input signal having frequency content is applied to an ink sample. In block 830, an ink signal is obtained, including a characteristic. For example, the characteristic may be an amplitude characteristic and/or a phase characteristic, for a given frequency. In block 840, the ink signal is evaluated in view of at least one reference value. In block 850, it is determined whether an evaluation interval has elapsed. If no, flow loops back to block 820. If yes, flow proceeds to block 860. In block 860, a frequency of the input signal is varied for the next evaluation interval. In block 870, a corresponding variation of the content of the ink signal is achieved. For example, the amplitude and/or phase may vary corresponding to the ink behavior and the variation in frequency of the input signal applied to the ink. In block 880, it is determined whether a representative waveform for the ink sample has been obtained. If not, flow loops back to block 820. If yes, flow proceeds to block 890. In block 890, it is identified whether the representative waveform is consistent with an ink signature. For example, a device may identify whether a given ink sample is consistent with OEM ink, or whether the ink sample is non-OEM ink. Flow ends at block 895.

What is claimed is:

1. A device comprising:

a signal module, to generate an input signal that contains frequency content, and to apply the input signal to a fluid sample to obtain a fluid signal including a characteristic corresponding to the frequency content and associated with an evaluation interval;

a comparison module to compare the fluid signal to a reference value corresponding to the characteristic; and an evaluation module to identify whether the fluid signal is consistent with a fluid signature, based on a comparison result from the comparison module, wherein the evaluation module includes a latch to determine, for the characteristic, whether the fluid signal reached the reference value;

wherein the signal module is contained on a fluid dispensing die, such that the device may generate the input signal on the fluid dispensing die.

2. The device of claim 1, wherein the signal module is to obtain the fluid signal according to obtaining at least one of i) an amplitude characteristic and ii) a phase characteristic of the fluid signal, corresponding to the frequency content of the evaluation interval.

3. The device of claim 1, further comprising a storage module to store at least one of i) a first reference value and ii) a second reference value corresponding to the evaluation interval;

wherein the comparison module is to determine whether the fluid signal corresponding to the characteristic includes an amplitude corresponding to at least one of i) the first reference value and ii) the second reference value.

4. The device of claim 3, wherein the storage module comprises at least one of i) a first register and ii) a second register to store at least one of i) the first reference value and ii) the second reference value, respectively, for at least a duration of the evaluation interval; and wherein at least one of i) the first register and ii) the second register is updateable to correspond to the given characteristic.

5. The device of claim 3, wherein the signal module is to cause the fluid signal amplitude to vary until the fluid signal amplitude corresponds to at least one of i) the first reference value and ii) the second reference value, for the given characteristic.

6. The device of claim 1, wherein, for a given characteristic, the comparison module is to adjust the reference value and compare the reference value with the fluid signal, until the reference value is consistent with the fluid signal, wherein the evaluation module is to identify that the fluid signal, for the given characteristic, corresponds to the reference value, to build a representative waveform of the fluid signature based on a plurality of characteristics.

7. The device of claim 1, wherein the signal module is to receive a clock signal, and generate the input signal based on the clock signal, wherein the signal module is to provide input signals of varying frequencies, to obtain corresponding fluid signals associated with corresponding characteristics and evaluation intervals.

8. The device of claim 7, wherein the signal module comprises a frequency divider and a sine wave filter to generate the input signal as a frequency selectable signal that contains frequency content.

9. The device of claim 1, wherein fluid comprises an ink.

10. The device of claim 1, wherein:

the comparison module includes at least one of i) a first voltage comparator and ii) a second voltage comparator, to compare the fluid signal to at least one reference value corresponding to the characteristic; and the evaluation module to identify whether the fluid signal is consistent with a fluid signature, based on at least one of i) a first latch and ii) a second latch to store a comparison result from the comparison module during the evaluation interval associated with the frequency content;

wherein the signal module is contained on a fluid dispensing die, such that the device may generate the input signal on the fluid dispensing die.

11. The device of claim 10, wherein the evaluation module further comprises an identifier contained on the fluid dispensing die, and wherein the evaluation module is to set the identifier based on identifying that the fluid signal is consistent with the fluid signature.

12. The device of claim 11, wherein the identifier is associated with a visible indicator.

13. A method of operating the device of claim 1, the method comprising:

with the signal module, applying, to a fluid sample at a fluid dispensing die, an input signal that contains frequency content to obtain a fluid signal including a characteristic corresponding to the frequency content and associated with an evaluation interval;

with the comparison module, comparing, at the fluid dispensing die, the fluid signal to at least one reference value corresponding to the characteristic;

with the evaluation module, identifying, at the fluid dispensing die, whether the fluid signal is consistent with a fluid signature, based on the comparing to the at least one reference value; and repeating the applying, comparing, and identifying for a plurality of characteristics and associated evaluation intervals to identify a representative waveform of the fluid sample.

14. The method of claim 13, further comprising iteratively varying the fluid signal from one evaluation interval to the next, until the fluid signal corresponds to the reference value.

15. The method of claim 13, further comprising iteratively varying the at least one reference value from one evaluation interval to the next, until the fluid signal corresponds to the reference value.

16. The device of claim 1, wherein the signal module is to obtain the fluid signal according to obtaining at least one of i) an amplitude characteristic and ii) a phase characteristic of the fluid signal, corresponding to the frequency content of the evaluation interval.

17. The device of claim 16, wherein the evaluation module includes a latch to determine, for the characteristic, whether the fluid signal reached the reference value.

18. The device of claim 16, wherein, for a given characteristic, the comparison module is to adjust the reference value and compare the reference value with the fluid signal, until the reference value is consistent with the fluid signal, wherein the evaluation module is to identify that the fluid signal, for the given characteristic, corresponds to the reference value, to build a representative waveform of the fluid signature based on a plurality of characteristics.

19. The device of claim 16, wherein the signal module is to receive a clock signal, and generate the input signal based on the clock signal, wherein the signal module is to provide input signals of varying frequencies, to obtain corresponding fluid signals associated with corresponding characteristics and evaluation intervals.

20. The device of claim 19, wherein the signal module comprises a frequency divider and a sine wave filter to generate the input signal as a frequency selectable signal that contains frequency content.

* * * * *